US006364658B1

(12) United States Patent
Ganeshan

(10) Patent No.: US 6,364,658 B1
(45) Date of Patent: Apr. 2, 2002

(54) PARTIALLY STUDDED RADIANT TUBES

(76) Inventor: Ram Ganeshan, 105 N. Hall Dr., Sugar Land, TX (US) 77478

( * ) Notice: Subject to any disclaimer, the term of this patent is extended or adjusted under 35 U.S.C. 154(b) by 0 days.

(21) Appl. No.: 09/681,276

(22) Filed: Mar. 12, 2001

(51) Int. Cl.[7] ..... F27B 5/14
(52) U.S. Cl. ..... 432/209; 432/226; 165/181
(58) Field of Search ..... 432/31, 175, 209, 432/210, 226; 165/181; 122/367.3; 138/138

(56) References Cited

U.S. PATENT DOCUMENTS 4,373,702 A * 2/1983 Jayaraman et al. ..... 432/175
4,581,800 A 4/1986 Johnson
4,877,087 A * 10/1989 Hill ..... 165/181
5,309,982 A * 5/1994 Aliano ..... 165/181

* cited by examiner

*Primary Examiner*—Gregory Wilson
(74) *Attorney, Agent, or Firm*—Daniel N. Lundeen; Lundeen & Arismendi, LLP

(57) ABSTRACT

The present invention utilizes extended surfaces, such as studs and fins, on a low-flux surface area of radiant heat transfer tubes in a fired furnace to more uniformly distribute heat flux. The invention increases the overall heat transfer of the tube by increasing heat flux rate for the backside of the tube, for example, and thus decreases the temperature differential between the opposing tube sides.

19 Claims, 6 Drawing Sheets

PARTIALLY STUDDED RADIANT TUBES

BACKGROUND OF INVENTION

The present invention is directed to heat transfer tubes used in the radiant section of a fired heater, and more particularly to radiant tubes provided with smooth surfaces at relatively high flux areas on the outside of the tube and extended surfaces on relatively low flux areas on the outside of the tube.

Combustion equipment is generally operated in chemical plants, petrochemical plants and refineries. The equipment may include industrial heaters, furnaces or plant boilers. This equipment is generally designed with bare or smooth-walled tubes. Use of bare tubes in radiant sections usually exposes the front half of the tube to direct flame radiation, while limiting the exposure of the rear half or dark side of the tube to reflected radiation. The difference in exposure is sufficient to cause the opposing sides of the tube to expand at different rates. As a result of the thermal stresses, the tubes will bow towards the direct flame radiation. To prevent tube stress the tube from exceeding design temperatures, the tube temperature must be maintained and regulated within specified safe temperature limits for the particular tube material.

The heat flux distribution around the circumference of a conventionally fired or radiating plane is on one side of the tube and a refractory wall is on the other. The front half of the tube surface faces the flame (point A) and receives a higher heat flux as compared to the rear half facing the refractory wall (point B). Point A receives heat flux only from direct flame radiation, while point B, facing the refractory wall, receives only reflected radiation coming from the refractory wall. Points between point A and point B receive varying amounts of both direct and reflected radiation, depending upon their location along the tube.

The standard distance between tubes is two tube diameters from center-to-center for most operations in the chemical and petrochemical industries, as shown in FIG. 2. The heat flux distribution in FIG. 1 is based on this configuration. For the purposes of an illustration using fluxes typical in a conventional fired heater, where the highest heat flux at point A is 18000 Btu/hr-ft$^2$, the diametrically opposed counterpart (point B) receives only 6000 Btu/hr-ft$^2$. The rear half of the tube transfers only 24% of the total heat absorbed by the tube; this includes both the direct and reflected radiation, as seen in FIG. 3. The average flux for the tube amounts to 10,000 Btu/hr-ft$^2$.

More than 85% of the heaters in the industry have such a large flux differential between the front and the rear side of the tube, as this illustration depicts. A significant compromise is made on the overall heat-receiving capacity of the tube in order to keep the flame-front side (point A) within safe working temperatures.

To make the heat flux distribution in the tube more uniform, one approach of the furnace designers has been to increase the center-to-center tube spacing requirements from 2 to 3 tube diameters. This design increases the flux at point B of the tube from 6,000 Btu/hr-ft$^2$ to 9,000 Btu/hr-ft$^2$ as shown in FIGS. 4A and 4B. The increased spacing has the beneficial result of increasing the heat-receiving capacity of the rear half of the tube for the 3D-spaced tubes, while heat flux distribution on the front half of the tube is generally the same as for the 2D-spaced tubes. This results in an increase of the average heat flux to 12,000 Btu/hr-ft$^2$ for the entire tube. However, the drawback of this solution is apparent. With an increase in tube spacing there is a corresponding increase in the size of the heater. This increases the cost and space requirements for the heater.

Another prior art approach improves the heat flux distribution by placing radiating flames on opposing sides of the tubes in a so-called "double-fired" design. A comparison is shown between one radiating flame (A) and two radiating flames (B) in FIGS. 5A and 5B, respectively. This design is commonly used in chemical processes that mandate a more uniform heat flux distribution, such as, for example, in delayed cokers, high-pressure hydrotreaters, ethylene furnaces, and the like. In a double-fired system, the front (point A) and rear (point B) portions of the tube have the same heat flux rate due to direct flame radiation, and the points at the margins between the front and rear receive relatively less direct flame radiation. The corresponding distribution of the heat flux, for the illustrative example, is 18,000 Btu/hr-ft$^2$ for the front and the rear locations, 13,500 Btu/hr-ft$^2$ at the margins between the front and rear faces, i.e. the middle area of the tube (point M at the 90 and 270 degree positions), resulting in an average flux of 15,000 Btu/hr-ft$^2$. The double-fired design brings with it the disadvantage that the heater has to be much larger, as much as twice the size as a single-fired unit, and correspondingly more expensive.

The present state of technology for heaters with a standard spacing of 2 tube-diameters will have a relative flux ratio of 1 to 1.8 between the average flux and the maximum flux, whereas a heater with a 3 tube-diameter spacing will have a relative flux ratio of 1 to 1.5, as shown in API Standard 530, Calculation of Heater-Tube Thickness in Petroleum Refineries, American Petroleum Institute (1988), FIG. C-1 Ratio of Maximum Local to Average Heat Flux Curves, page 103).

The 3 tube-diameter design is less common in the industry and the vessel must be significantly larger than a 2 tube-diameter design. The average to maximum flux ratio of the double-fired tubes is significantly lower at 1 to 1.2, but is a more costly alternative of the three designs for an industrial plant.

SUMMARY OF INVENTION

The present invention utilizes extended surfaces, such as studs and fins, on the low-flux area(s) of radiant tubes to more uniformly distribute heat flux. In the single-fired furnace design, for example, the invention increases the overall heat transfer of the tube by increasing heat flux rate for the backside of the tube and thus decreases the temperature differential between the opposing tube sides.

In one aspect, the invention provides a tube for use in a fired furnace wherein the tube is disposed longitudinally between a flame and a refractory wall. The tube has a central longitudinal bore for the passage therethrough of a fluid to be heated, an imperforate outside diameter having a radiant side for exposure to radiation from the flame and a dark side essentially free of direct exposure to the flame, and a plurality of extended surfaces positioned on at least a part of the dark side of the outside diameter effective to increase heat flux of the dark side. The radiant side of the outside diameter is essentially free of extended surfaces, excluding margins thereof adjacent the dark side which can optionally be provided with extended surfaces. The extended surfaces are preferably studs or fins welded to the dark side of the outside diameter.

In another aspect the invention provides a fired furnace comprising a plurality of the tubes as described above, wherein the tubes are disposed in the furnace between a flame and a refractory wall with the radiant side of the outside diameter facing the flame and the dark side facing the refractory wall.

In a further aspect, the invention also provides an improvement in a fired furnace comprising a plurality of tubes disposed between a flame and a refractory wall, each tube including a central longitudinal bore for the passage therethrough of a fluid to be heated, an outside diameter having a radiant side for exposure to radiation from the flame and a dark side essentially free of direct exposure to the flame. The improvement comprises a plurality of extended surfaces disposed on the dark side of the outside diameter and a smooth surface substantially free from extended surfaces disposed on the radiant side of the tubes, except optionally at the margins thereof adjacent to the dark side which can optionally be provided with extended surfaces.

A still further aspect of the invention is the provision of a method for improving the heat transfer in a fired furnace comprising a plurality of tubes disposed between a flame and a refractory wall, each tube having a smooth outside diameter essentially free of extended surfaces. The method includes the steps of removing and replacing one or more of the tubes in the furnace with tubes including a central longitudinal bore for the passage therethrough of a fluid to be heated, an outside diameter having a radiant side for exposure to radiation from the flame and a dark side essentially free of direct exposure to the flame, and a plurality of extended surfaces positioned on at least a part of the dark side of the outside diameter effective to increase heat flux of the dark side, wherein the radiant side of the outside diameter, optionally excluding margins thereof adjacent the dark side, is essentially free of extended surfaces.

A related aspect of the invention is the provision of a method for improving the heat transfer in a fired furnace comprising a plurality of tubes disposed between a flame and a refractory wall, each tube having a smooth outside diameter essentially free of extended surfaces. The method includes the steps of mapping the heat flux on the exterior surface of the smooth tubes in the furnace, determining the relatively low flux areas of the tubes, removing the smooth tubes from the furnace, installing extended surface structures on the exterior surface of replacement tubes at the low flux areas determined from the mapping step, and installing the replacement tubes in the furnace. The replacement tubes have a central longitudinal bore for the passage therethrough of a fluid to be heated, an outside diameter having a radiant side for exposure to radiation from the flame and a dark side essentially free of direct exposure to the flame, and extended surfaces comprising a plurality of the extended surface structures positioned on at least a part of the dark side of the outside diameter effective to increase heat flux of the dark side, wherein the radiant side of the outside diameter, optionally excluding margins thereof adjacent the dark side, is essentially free of extended surfaces. The extended surfaces can have an area that varies proportionally to the difference between the maximum heat flux of the tube and the mapped heat flux in the vicinity of the extended surface structure. The area of the extended surfaces can be varied by varying the proximity of the extended surface structures to adjacent extended surface structures, or by varying the area of the extended surface structures relative to adjacent extended surface structures.

The extended surfaces on the tubes described above can have a larger area in a central region of the dark side relative to the area of the extended surfaces adjacent to margins between the dark and radiant sides. Alternatively or additionally, the extended surfaces can have an area that varies generally inversely proportional to heat flux. For example, studs measuring ½-in. diameter by ½-in. High can be welded to the exterior of the tube at the point closest to the refractory wall, while studs measuring ¼-in. diameter by ¼-in. tall can be welded to the exterior of the tube at the margins between the dark and radiant sides, and the studs between these can vary gradually from ¼-in. at the margins to ½-in. at the center of the dark side.

In another aspect the invention provides a tube for use in a fired furnace wherein the tube is disposed longitudinally between flames on either side thereof. The tube includes a central longitudinal bore for the passage therethrough of a fluid to be heated, an outside diameter having opposing radiant sides for exposure to radiation from a respective flame, opposing relatively low-flux margins between the radiant sides, and a plurality of extended surfaces positioned in the margins on the outside diameter of the tube effective to increase heat flux at the margins and reduce the ratio of maximum to average heat flux. The radiant sides of the outside diameter between the margins is essentially free of extended surfaces.

DETAILED DESCRIPTION

Enhancing the heat transfer rate by using extended surfaces is a well-known technology and is widely practiced in convection heaters, but as far as applicant is aware, has never heretofore been practiced by partially studding or finning tubes in a fired or radiant service. In fact, a majority of the heaters have convection sections with extended surface tubes. The novelty of this invention rests, in part, on its application of extended surface heat transfer to radiant tubes. The invention requires extended surfaces to be placed at locations where flux rates are established to be low. Additionally, only the appropriate type and thickness of extended surfaces (i.e. studs and/or fins) will be used so that they will remain close to the tube-wall temperature. The third requirement prevents the extended surface from becoming oxidized in a short time, rendering the extended surface useless.

Existing standard heaters using radiant tubing can obtain an enhanced heat transfer rate with the addition of extended surface studs on the refractory side of the radiant tubes. The average heat flux increase after the installation of the extended surface studs according to the present invention can range between 10 and 25 percent, preferably from 15 to 20 percent. For example, where the present average flux is 10,000 Btu/hr-ft$^2$ before installation, the average flux after installation of the studs can be increased to 12,000 Btu/hr-ft$^2$. Heaters with 3-diameter tube spacing will realize an increased average flux near 14,000 to 15,000 Btu/hr-ft$^2$ after installation, thus approaching the heat transfer rate of more expensive double-fired units. With a higher average flux rate and a more uniform heat transfer, heaters with the 3-diameter tube spacing modified the partially-studded wall tubes of the present invention are a competitive alternative to the double-fired furnaces for delayed cokers and other critical heat flux heaters. Installation of the partially studded tubes may occur at the next regularly scheduled heater shutdown. No additional modifications to the heater are necessary. The cost of installing partially studded tubes is low compared to the savings realized as a result of the increased capacity.

New heaters designed with partially studded radiant tubes will absorb more heat in the radiant section than conventionally designed heaters and therefore will be smaller in size and more economical. Using the principles of the present invention, a 15 to 20 percent capital cost reduction can be realized.

Figure 1:
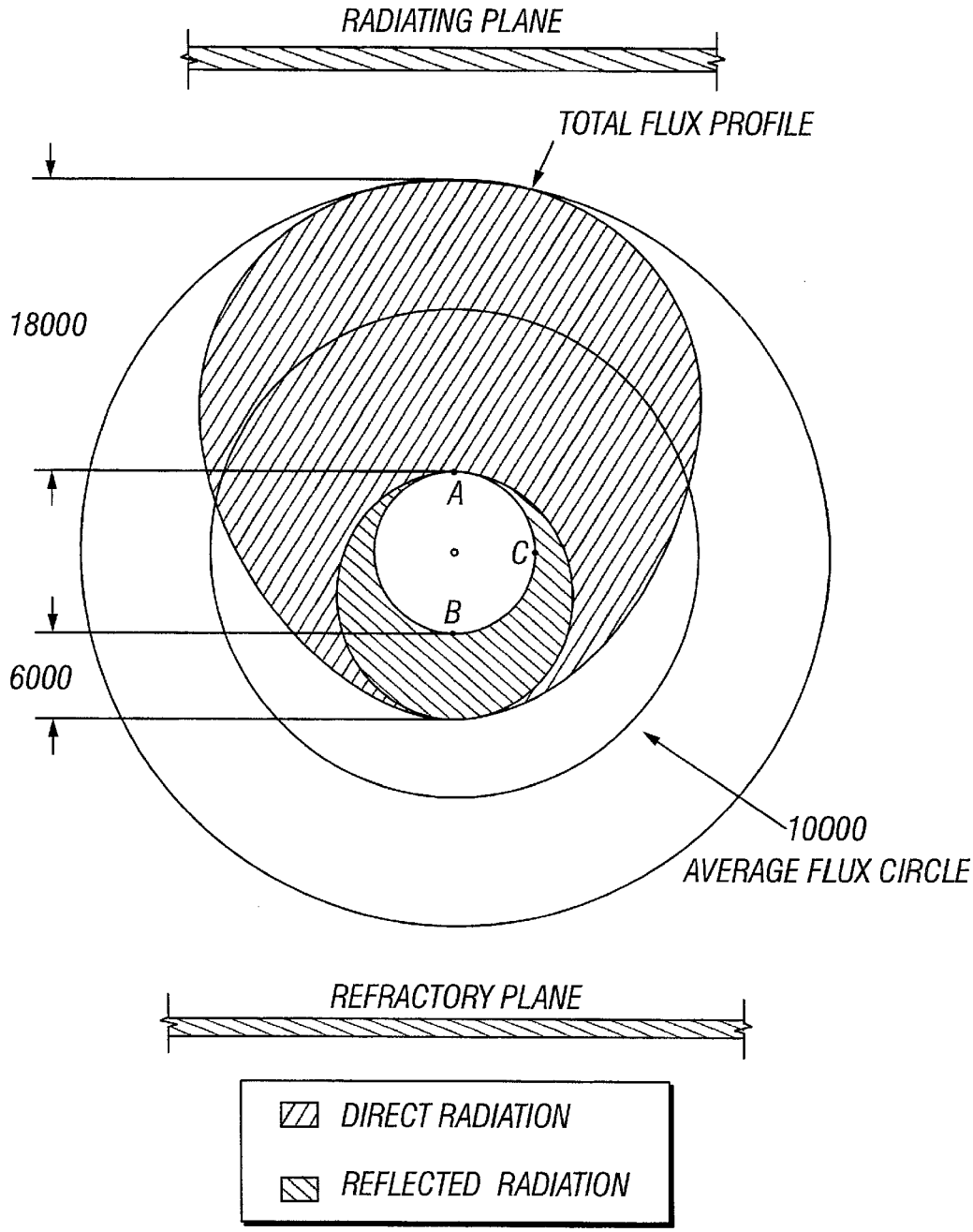
FIG. 1 (Prior Art)
FIG. 1 is a simplified schematic of the heat flux influence on tubing using a single radiating plane with an accompanying refractory wall.
Figure 2:
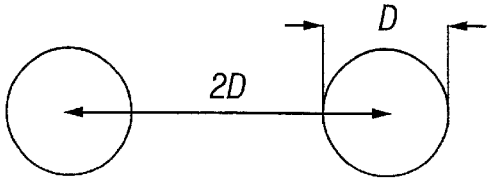
FIG. 2 (Prior Art)
FIG. 2 is a simplified schematic of the standard spacing between tubes.
Figure 3:
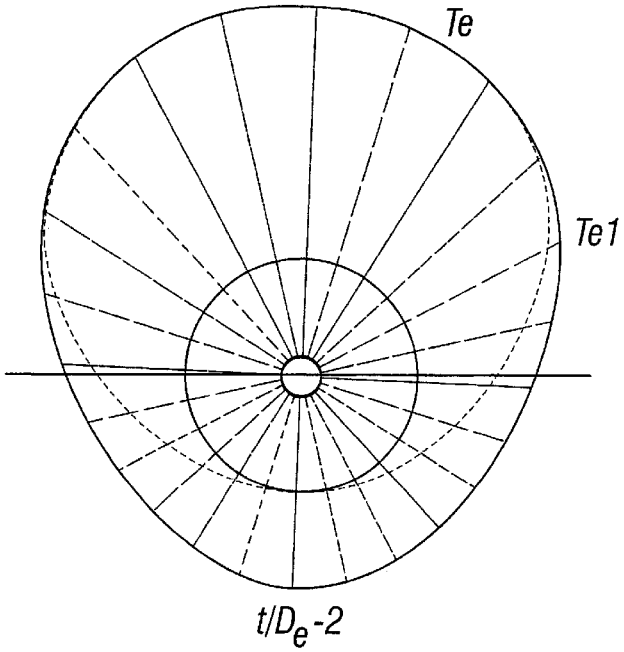
FIG. 3 (Prior Art)
FIG. 3 is a simplified schematic comparing the heat flux received on opposing sides of the tubing.
Figure 4A:
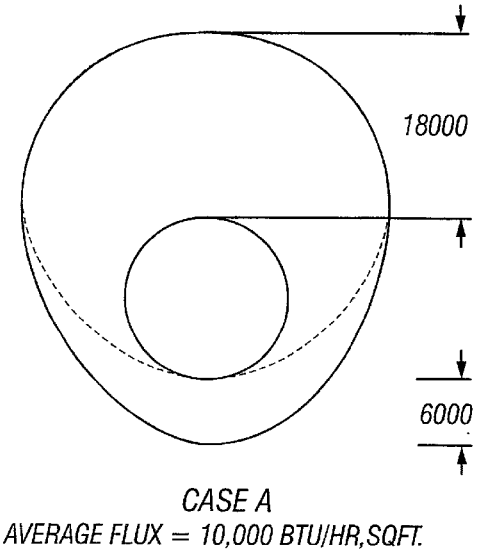
FIG. 4A (Prior Art)
FIG. 4 is a simplified schematic comparing the relative heat flux distribution based on different tube spacing.
Figure 4B:
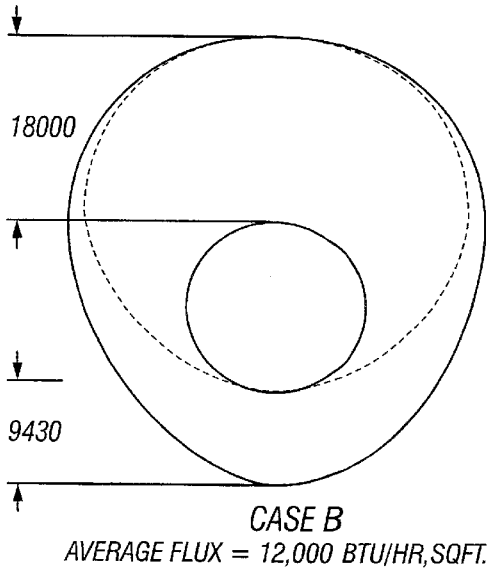
FIG. 4B (Prior Art)
Figure 5A:
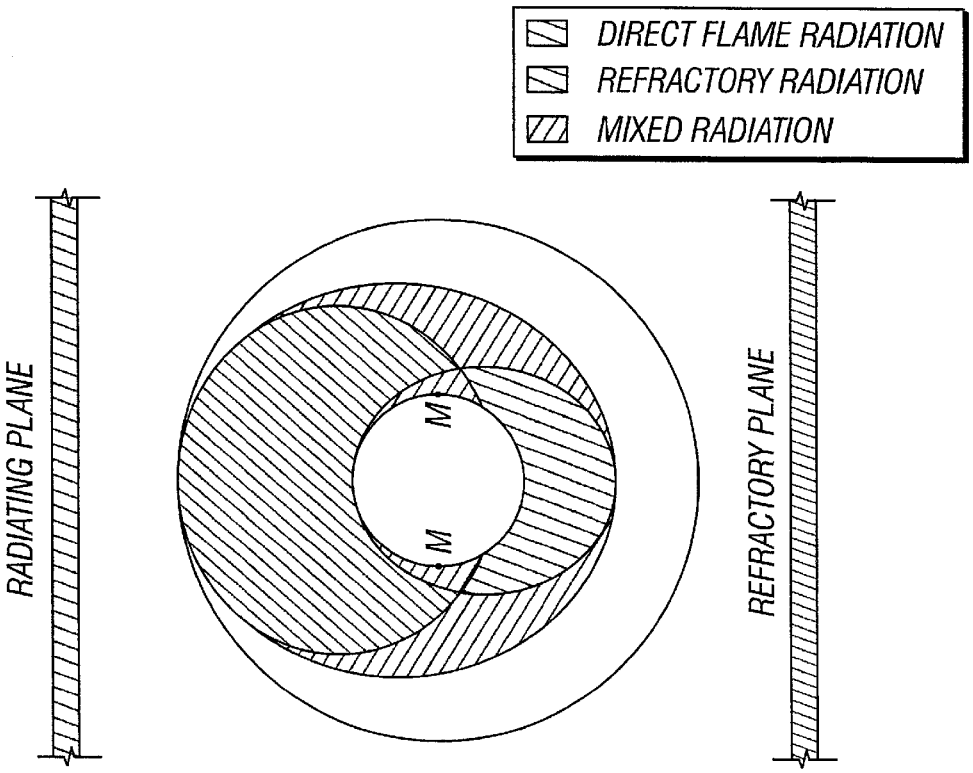
FIG. 5A (Prior Art)
FIGS. 5A and 5B are simplified schematics comparing the heat flux influence on tubing using a single radiant plane (FIG. 5A) to a double radiant plane (FIG. 5B).
Figure 5B:
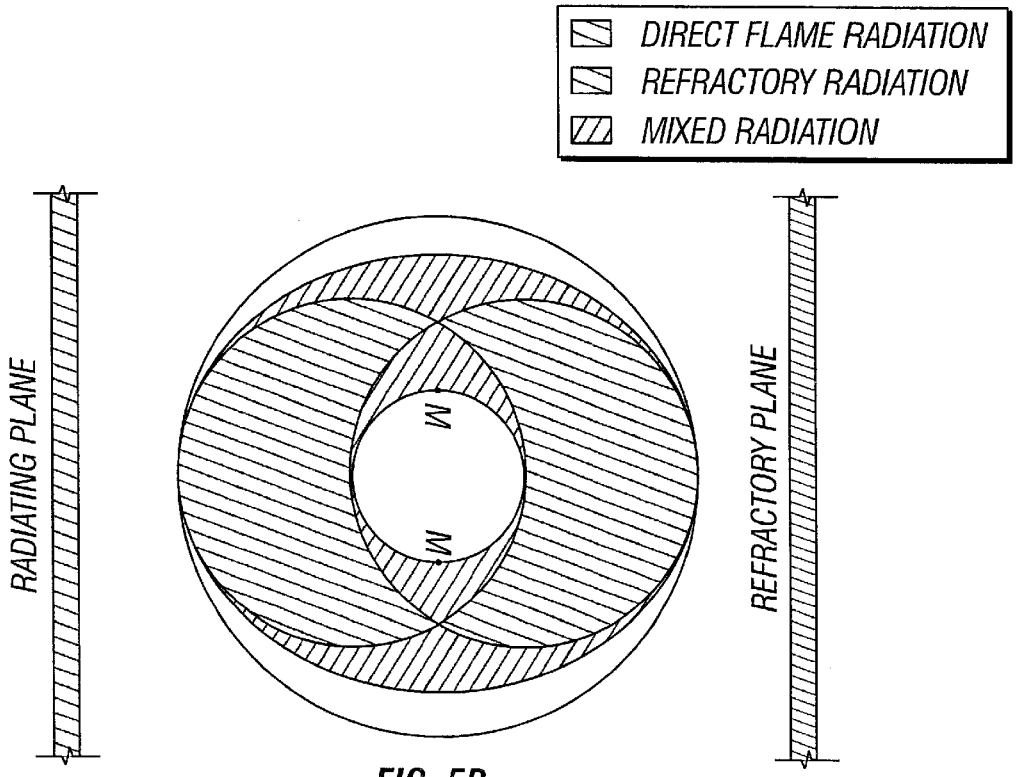
FIG. 5B (Prior Art)
Figure 6:
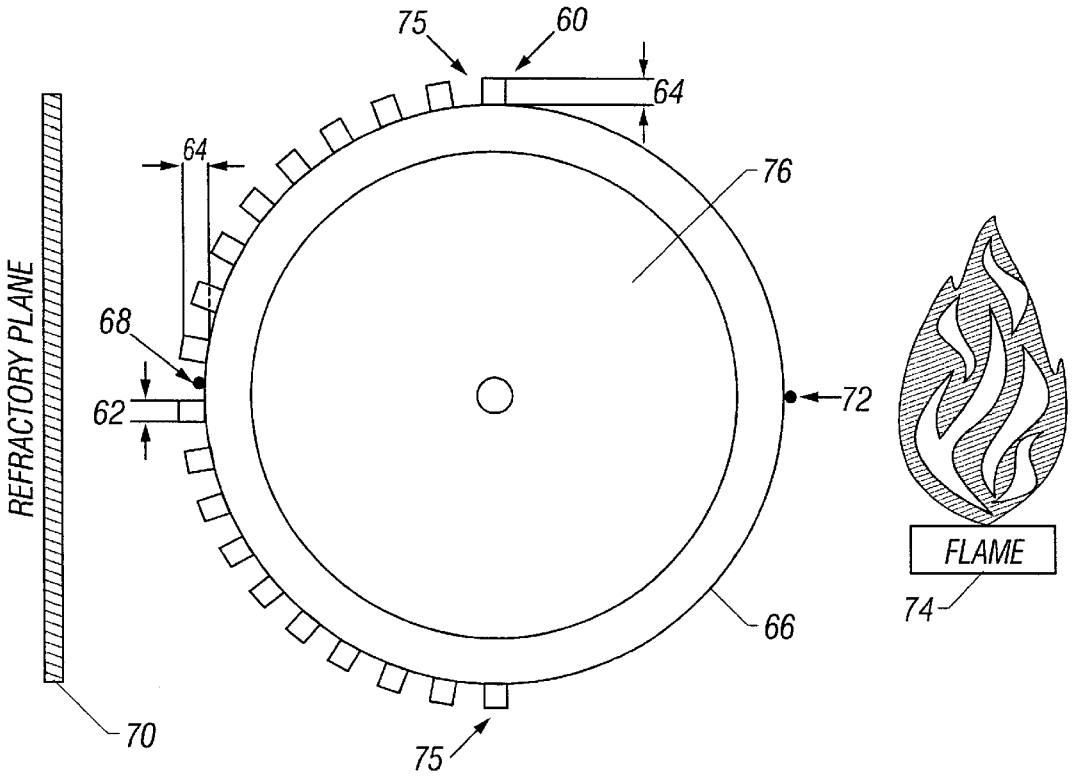
FIG. 6 is a simplified schematic of uniform extended surfaces attached to radiant tubing.
Figure 7:
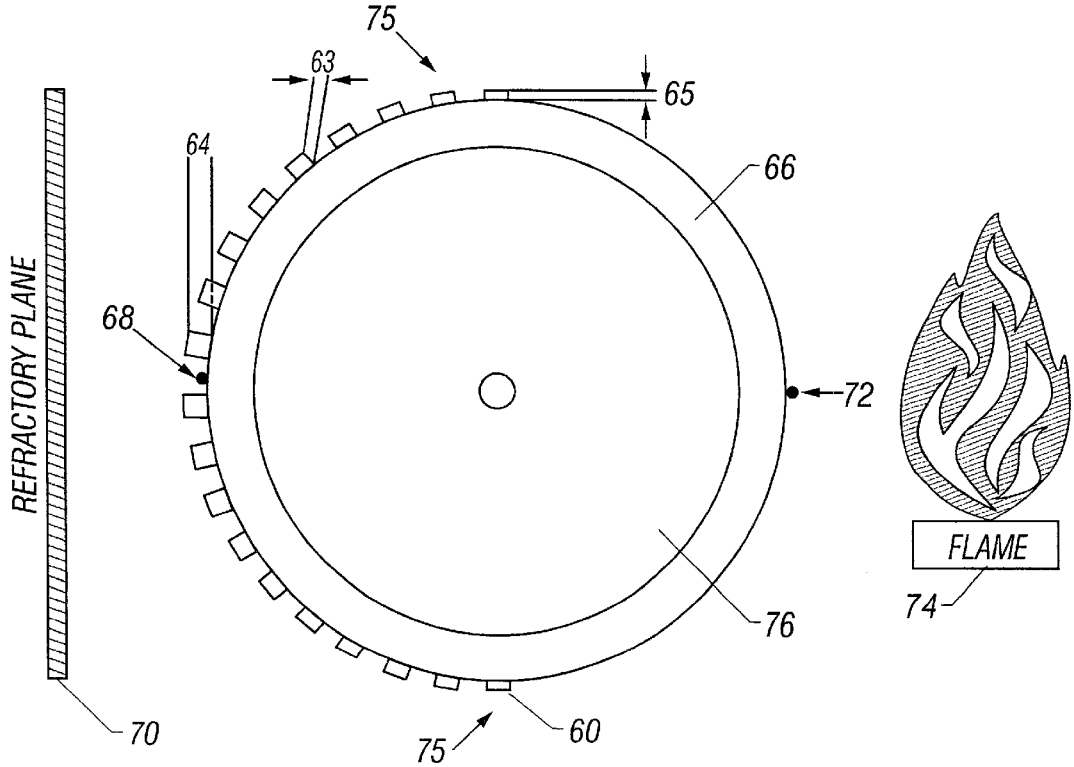
FIG. 7 is a simplified schematic of variable-sized extended surfaces attached to radiant tubing.
Figure 8A:
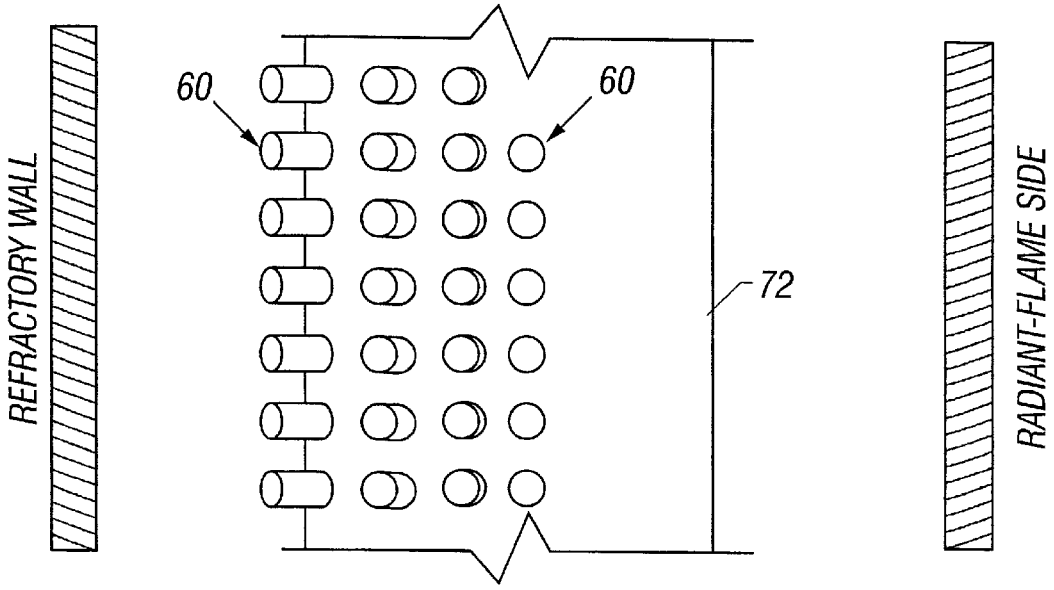
FIG. 8 is a simplified schematic elevation showing the margin of radiant tubing according to the invention where the bare wall without installed studs meets the low-flux wall area provided with studs.
Figure 8B:
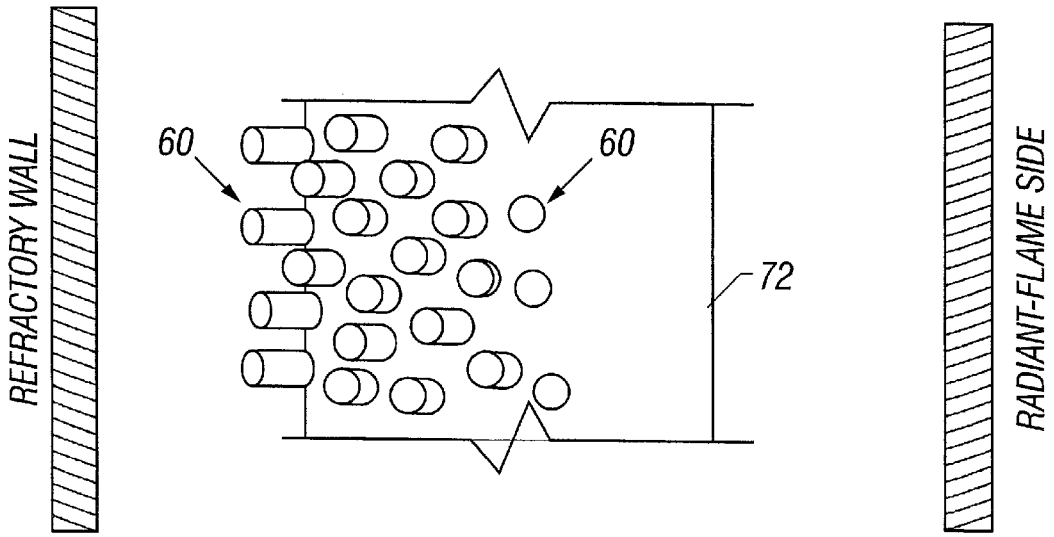

The utilization of studs as the extended surface for radiant tubes is the preferred embodiment of the invention. As seen in FIGS. 6–8, studs 60 generally have a diameter 62 of one-half inch with a height 64 of one inch, but may vary according to the heat requirements and may range from three-eighths 63 to one-fourth of an inch 65. The studs 60 are made from any suitable material that can be used in the furnace, such as, for example, carbon steel, stainless steel, alloy steels, Inconel, and other high temperature ferrous and non-ferrous allows. Studs 60 are welded or fixed by other means to the tubing 66 on the dark side 68 of the tube facing the refractory wall 70. The studs 60 are not generally located on the light side 72 of the tubing 66facing the radiant side 74. The studs 60 can, if desired, be located in the area of the margins 75, or the margins 75 can be free of studs 60, depending on the flux rates at the margins 75 with and without the studs 60 there.

The heat transfer efficiency for studs 60 is at or near 90–95% and is well established in technical literature and industrial design practice. Due to the high efficiency rate and conduction, the stud temperature will be at or near that of the tube temperature. Likewise, the tube temperature is at or near that of the fluid 76 flowing within the central bore 77 of the tube due to the high heat transfer coefficient of the fluid. This relatively minor change in temperature between the fluid 76, the tube 66, and the studded extended surfaces 60 indicates that the use of studded extended surfaces will last for extended periods of time without disruption.

In a preferred embodiment, the heat fluxes on the exterior surface area of the bare tubes in a furnace design can be measured or mathematically modeled using a conventionally-available modeling tool to map the heat flux distribution. This can be done with an existing furnace to be modified according to the present invention in a revamp application, or for a new furnace design in which the present invention is to be utilized. Then, with the aid of this information, the exterior surface of the tube can be provided with extended surfaces, which add heat transfer area to the exterior of the tube where the flux is low. Preferably, the area of the extended surfaces varies proportionally with the difference between the maximum flux and the mapped flux so that the flux is as uniform as possible. The area of the extended surfaces can be varied by the number and spacing of the extended surface structures and/or by varying the size of the extended surface structures. The tubes with the extended surfaces in place in the low-flux areas can then be modeled again to confirm or optimize the placement of the extended surfaces. The tubes are then constructed or modified in accordance with the model to achieve the improved heat flux that is desired.

Figure 9:
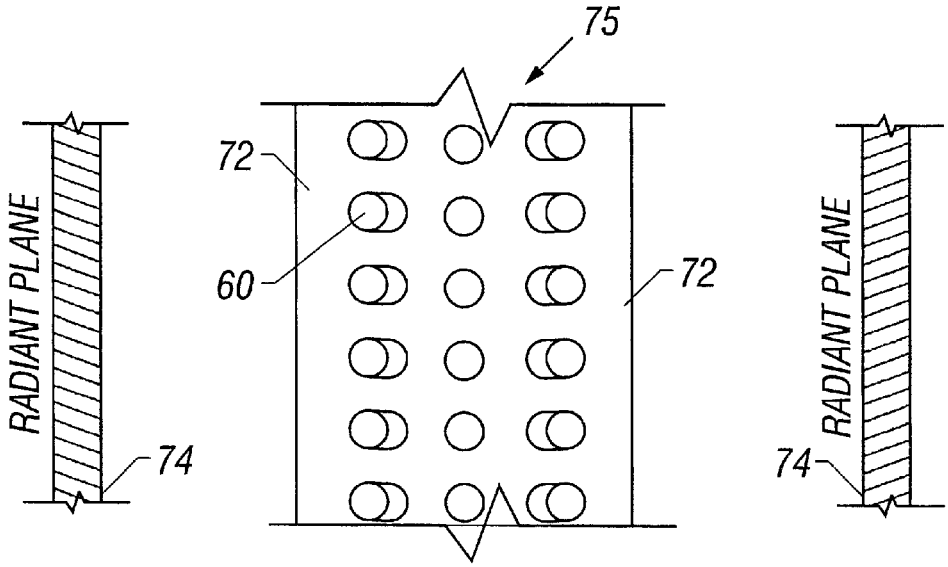
FIG. 9 is a simplified schematic elevation showing the margin of a double-fired tube according to an alternate embodiment of the invention.

The invention can also be used in double-fired heaters as best illustrated in FIG. 9. The studs 60 are positioned along the low-flux margins 75 to increase heat transfer at the margins 75. This double-fired design further minimizes the already low ratio of maximum to average heat flux, and is particularly advantageous in critical process equipment such as in delayed cokers, high-pressure hydrotreaters, ethylene furnaces, and the like.

Figure 10:
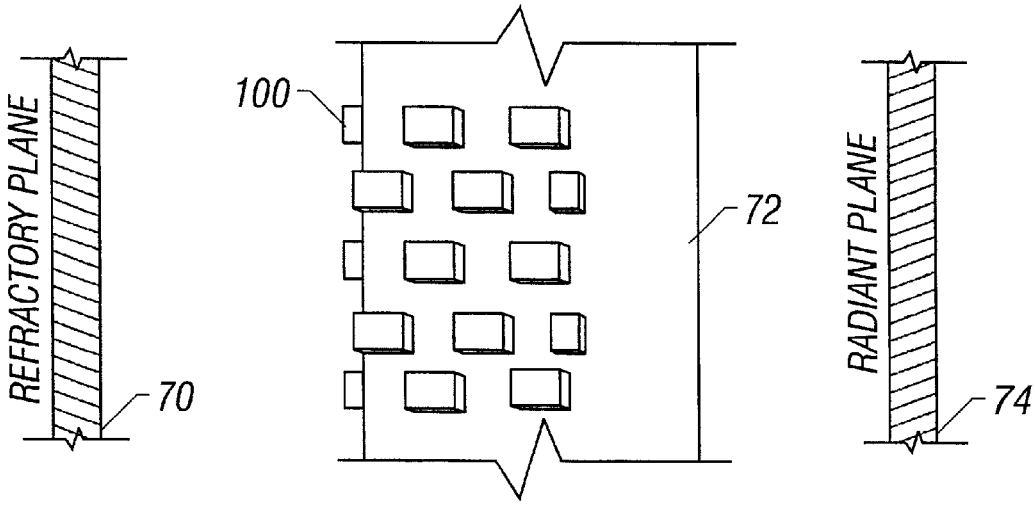
FIG. 10 is a simplified schematic elevation of a partially finned tube according to an alternate embodiment of the invention.

Use of fins 100 as the extended surface for radiant tubes, as illustrated in FIG. 10, instead of studded extended surfaces 60, will be limited to specific situations. Finned surfaces have the disadvantage of a lower heat transfer efficiency. Fins are thin (usually 0.1-in. thick) and do not conduct heat as rapidly as studs. Due to their thinness, fins are prone to oxidation and burnout faster. When the use of a partially finned extended surface is needed, the fin shall be thick enough (e.g., one-quarter inch) so that the heat received is immediately conducted into the tube, while maintaining the extended surface temperature to that of the tube wall.

The use of the extended surfaces on the low-flux area of the radiant tubes generally increases the radiant heat transfer. In addition, the extended surfaces in the rear side of the tubes also increases the convection heat transfer of the rear side of the tube. A downward convection flow of flue gases exists between the radiant tubes and the refractory wall in all vertical heaters due to thermal currents and differences in flue gas densities. The cooler, denser flue gases descend behind the tubes, while the higher temperature, lower density gases rise in the center of the heater. Convection currents behind the tubes contribute to approximately 7% of the total heat transferred in the radiant section, as reported in Lobo et al., "Heat Transfer in the radiant section of petroleum heaters," *American Institute of Chemical Engineers Journal*, 750 (1939). By adding studs in the convection flow zone, the increased turbulence will present an opportunity to provide as much as twice the heat transfer due to convection. This embodiment improves the heat transfer rate to the dark side of the tubes and allows for a smaller heater.

Partially studded tubing may be used to control differential expansion between opposing sides of radiant tubes. The tube generally bows inwardly toward the flame because different expansions rates of the tube material occur from one side of the tube to the other. This expansion can cause the tube supports to fail and may allow the tubes to fail, or the tubes can rupture or fail in place causing a hazardous situation for the unit and/or for the plant. Partially studded tubes equalize this temperature difference between the front and the back by bringing the heat fluxes closer together. In addition, the tube may be stronger structurally due to the refractory side placement of the extended surface. Partially studded tubes provide a safer work environment and increase the working life of the tubes.

What is claimed is:

1. A tube in a fired furnace wherein the tube is disposed longitudinally between a flame and a refractory wall, comprising:

a central longitudinal bore for the passage therethrough of a fluid to be heated;

an imperforate outside diameter having a radiant side for exposure to radiation from the flame and a dark side essentially free of direct exposure to the flame;

a plurality of extended surfaces positioned on at least a part of the dark side of the outside diameter effective to increase heat flux of the dark side;

wherein the radiant side of the outside diameter, excluding margins thereof adjacent the dark side, is essentially free of extended surfaces.

2. The tube of claim 1 wherein the extended surfaces comprise studs welded to the dark side of the outside diameter.

3. The tube of claim 1 wherein the extended surfaces comprise fins.

4. A fired furnace, comprising:

a plurality of tubes, comprising a central longitudinal bore for the passage therethrough of a fluid to be heated;

an outside diameter having a radiant side for exposure to radiation from the flame and a dark side essentially free of direct exposure to the flame;

a plurality of extended surfaces positioned on at least a part of the dark side of the outside diameter effective to increase heat flux of the dark side;

wherein the radiant side of the outside diameter, optionally excluding margins thereof adjacent the dark side, is essentially free of extended surfaces, wherein the tubes are disposed in the furnace between a flame and a refractory wall with the radiant side of the outside diameter facing the flame and the dark side facing the refractory wall.

5. The invention of claim 4 wherein the tubes are spaced at two tube diameters center-to-center.

6. The invention of claim 1 wherein the extended surfaces have an area that varies proportionally to the difference between the maximum heat flux of the tube and the mapped heat flux in the vicinity of the extended surface structure.

7. The invention of claim 6 wherein the area of the extended surfaces is varied by varying the proximity of the extended surface structures to adjacent extended surface structures.

8. The invention of claim 6 wherein the area of the extended surfaces is varied by varying the area of the extended surface structures relative to adjacent extended surface structures.

9. In a fired furnace comprising a plurality of tubes disposed between a flame and a refractory wall, each tube including a central longitudinal bore for the passage therethrough of a fluid to be heated and an outside diameter having a radiant side for exposure to radiation from the flame and a dark side essentially free of direct exposure to the flame, the improvement comprising:

a plurality of extended surfaces disposed on the dark side of the outside diameter;

a smooth surface substantially free from extended surfaces disposed on the radiant side of the tubes except optionally at the margins thereof adjacent to the dark side.

10. A method for improving the heat transfer in a fired furnace comprising a plurality of tubes disposed between a flame and a refractory wall, each tube having a smooth outside diameter essentially free of extended surfaces, comprising:

removing and replacing one or more of the smooth tubes in the furnace with one or more tubes comprising a central longitudinal bore for the passage therethrough of a fluid to be heated;

an outside diameter having a radiant side for exposure to radiation from the flame and a dark side essentially free of direct exposure to the flame;

a plurality of extended surfaces positioned on at least a part of the dark side of the outside diameter effective to increase heat flux of the dark side;

wherein the radiant side of the outside diameter, optionally excluding margins thereof adjacent the dark side, is essentially free of extended surfaces.

11. The invention of claim 4 wherein the extended surfaces have a larger area in a central region of the dark side relative to the area of the extended surfaces adjacent to margins between the dark and radiant sides.

12. The invention of claim 11 wherein the extended surfaces have an area that varies generally inversely proportional to heat flux.

13. The invention of claim 9 wherein the extended surfaces have a larger area in a central region of the dark side relative to the area of the extended surfaces adjacent to margins between the dark and radiant sides.

14. The invention of claim 13 wherein the extended surfaces have an area that varies generally inversely proportional to heat flux.

15. A tube for use in a fired furnace wherein the tube is disposed longitudinally between a flame and a refractory wall, comprising:

a central longitudinal bore for the passage therethrough of a fluid to be heated;

an outside diameter having a radiant side for exposure to radiation from the flame and a dark side essentially free of direct exposure to the flame;

a plurality of extended surfaces positioned on at least a part of the dark side of the outside diameter effective to increase heat flux of the dark side;

wherein the radiant side of the outside diameter, optionally excluding margins thereof adjacent the dark side, is essentially free of extended surfaces, wherein the extended surfaces have a larger area in a central region of the dark side relative to the area of the extended surfaces adjacent to margins between the dark and radiant sides.

16. The invention of claim 15 wherein the extended surfaces have an area that varies generally inversely proportional to heat flux.

17. The invention of claim 4 wherein the tubes are spaced at three tube diameters center-to-center.

18. A method for improving the heat transfer in a fired furnace comprising a plurality of tubes disposed between a flame and a refractory wall, each tube having a smooth outside diameter essentially free of extended surfaces, comprising:

mapping the heat flux on the exterior surface of the smooth tubes in the furnace, determining the relatively low flux areas of the tubes, removing the smooth tubes from the furnace, installing extended surface structures on exterior surfaces of replacement tubes at the low flux areas determined from the mapping step, the replacement tubes comprising a central longitudinal bore for the passage therethrough of a fluid to be heated;

an outside diameter having a radiant side for exposure to radiation from the flame and a dark side essentially free of direct exposure to the flame;

extended surfaces comprising a plurality of the extended surface structures positioned on at least a part of the dark side of the outside diameter effective to increase heat flux of the dark side;

wherein the radiant side of the outside diameter, optionally excluding margins thereof adjacent the dark side, is essentially free of extended surfaces, and installing the replacement tubes in the furnace.

19. A tube in a fired furnace wherein the tube is disposed longitudinally between flames on either side thereof, comprising:

a central longitudinal bore for the passage therethrough of a fluid to be heated;

an imperforate outside diameter having opposing radiant sides for exposure to radiation from a respective flame and opposing margins between the radiant sides;

a plurality of extended surfaces positioned in the margins on the outside diameter of the tube effective to increase heat flux at the margins;

wherein the radiant sides of the outside diameter between the margins are essentially free of extended surfaces.

* * * * *